US005647539A

United States Patent [19]

Dobbs et al.

[11] Patent Number: 5,647,539

[45] Date of Patent: Jul. 15, 1997

[54] FOAMER NOZZLE ASSEMBLY FOR TRIGGER SPRAYER

[75] Inventors: Douglas B. Dobbs, Yorba Linda; Adonis Spathias, Corona, both of Calif.

[73] Assignee: Calmar Inc., City of Industry, Calif.

[21] Appl. No.: 392,397

[22] Filed: Feb. 22, 1995

Related U.S. Application Data

[63] Continuation-in-part of Ser. No. 352,805, Dec. 1, 1994, abandoned.

[51] Int. Cl.[6] ..... B05B 7/30

[52] U.S. Cl. ..... 239/504; 239/428.5

[58] Field of Search ..... 239/504, 343, 239/333, 428.5

[56] References Cited

U.S. PATENT DOCUMENTS

| | | | |
|---|---|---|---|
| 2,086,944 | 7/1937 | Palsson . | |
| 3,388,868 | 6/1968 | Watson et al. | 239/428.5 |
| 3,420,310 | 1/1969 | Mears et al. | 239/504 |
| 4,219,159 | 8/1980 | Wesner | 239/343 |
| 4,603,812 | 8/1986 | Stoesser et al. . | |
| 4,768,717 | 9/1988 | Shay . | |
| 4,779,803 | 10/1988 | Corsette . | |
| 4,883,227 | 11/1989 | Maas . | |
| 4,890,792 | 1/1990 | Martin et al. . | |
| 4,925,106 | 5/1990 | Maas et al. | 239/504 |
| 4,971,252 | 11/1990 | Tasaki et al. . | |

*Primary Examiner*—Matthew C. Graham
*Attorney, Agent, or Firm*—Watson Cole Stevens Davis, P.L.L.C.

[57] ABSTRACT

A foamer nozzle assembly combines a turbulence chamber with a foam enhancer comprising a plurality of spaced ribs defining uniform openings, the ribs having flat surfaces lying perpendicular to the inner wall of the chamber for further generating foam as the foam bubbles impact against such flat surfaces to further mix with the air in the turbulence chamber.

15 Claims, 2 Drawing Sheets

FOAMER NOZZLE ASSEMBLY FOR TRIGGER SPRAYER

RELATED APPLICATION

This application is a continuation-in-part of Ser. No. 08/352,805, filed Dec. 1, 1994, and now abandoned.

BACKGROUND OF THE INVENTION

This invention relates generally to foyer nozzles for trigger sprayers, and more particularly to foamer nozzles having a turbulence chamber for creating foam in combination with a molded plastic grating to enhance foaming.

Pump sprayers capable of dispensing especially household cleaning product formulations as a foam are enjoying increased demand, and foam dispensers of various types are known in the art. There is a continuing effort by the product manufacturers to increase the effectiveness of their solutions. This generally means an increase in the concentration of the active ingredient and in the time the product hangs on the predominantly vertical target surfaces.

With household cleaners, which may include bleach based solutions, the vapor produced when sprayed in a small enclosed space of a bathroom or shower may cause severe burning of the nose, mouth and eyes. Some foamers on the market produce a reasonably acceptable foam quality but also introduce a large amount airborne droplets into the atmosphere which give rise to such produced vapors.

Some other foamers may significantly reduce the amount of airborne particles but do not produce an optimal foam.

A foam generating pump sprayer is disclosed in U.S. Pat. No. 4,603,812 as having a foam-forming device which includes a wire mesh screen retained in the path of the spray such that substantially all the spray passes through the foam forming device without contact except by the screen.

A foamer nozzle disclosed in U.S. Pat. No. 4,768,717 has a wire mesh screen disk in combination with a turbulence chamber to enhance the foam-producing capabilities of the nozzle.

A foam nozzle assembly disclosed in U.S. Pat. No. 4,925,106 has a perforated wall in combination with a foam generating chamber, the wall having ribs and slots therein and the back edges of the positions of the ribs between slots being rounded to provide a surface upon which the conical spray can impinge and be deflected in different directions to mix with air in a foam generating chamber to create foam.

Foamer nozzles are disclosed in U.S. Pat. Nos. 4,883,227 and 4,971,252 as having impingement protuberances within a turbulence chamber for creating foam.

SUMMARY OF THE INVENTION

It is the general objective of this invention to provide a foamer which significantly reduces the amount of airborne droplets into the atmosphere while at the same time creates an acceptable quality foam which does not dribble when applied to the target and which hangs to the target through an acceptable interval.

This objective is achieved by the provision of a foamer nozzle assembly having a smooth walled cylinder against which the spray plume impacts creating and concentrating the foam which impacts and passes through a foam enhancer having a plurality of spaced ribs defining uniform openings, the ribs having flat surfaces lying perpendicular to the cylinder wall for further generating foam.

The ribs may intersect in the form of a grid, or may all extend in a common direction in the form of a grill with two sets of such ribs lying in spaced planes and being offset relative to one another. Otherwise the two sets of offset ribs may be interwoven by crossing ribs of a zig-zap shape. Still further, the ribs may lie in separate parallel planes, the ribs in one plane being contiguous to and extending perpendicular to the ribs in the other plane.

The ribs may be trapezoidal in cross-section and, when lying in spaced planes, sidewalls of the downstream ribs may converge/diverge in a downstream direction and sidewalls of the upstream ribs may converge/diverge in the downstream direction.

Otherwise the ribs may be rectangular in cross-section with the longer sides of the ribs extending in the downstream direction.

Other objects, advantages and novel features of the invention will become more apparent from the following detailed description of the invention when taken in conjunction with the accompanying drawings.

DETAILED DESCRIPTION OF THE INVENTION

Figure 1:
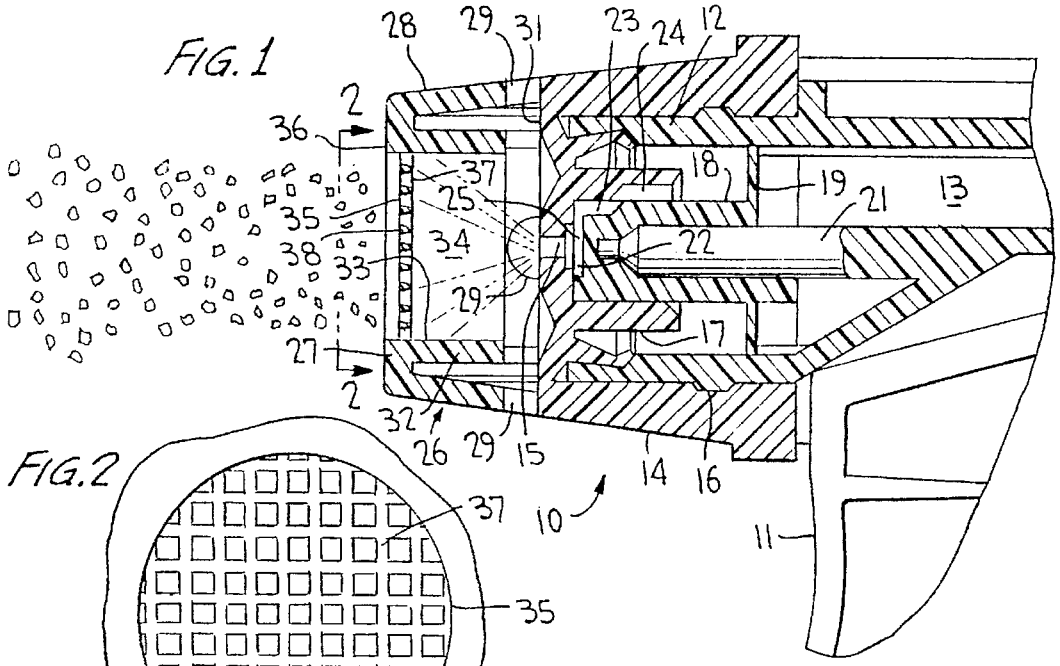
FIG. 1 is a vertical sectional view of one embodiment of the foamer nozzle assembly of the invention mounted at the discharge end of a trigger sprayer.

Turning now to the drawings wherein like reference characters refer to like and corresponding parts throughout the several views, a trigger pump sprayer generally designated 10 is shown in FIG. 1 of known construction as having a trigger actuator 11 and a discharge end 12 into which liquid product flows through a discharge passage 13 upon pumping operation.

A rotatable nozzle cap 14 having a central discharge orifice 15 is snap-fitted about the discharge end as at 16. The cap has an internal sleeve 17 in engagement with a probe cap 18 carrying an annular discharge flap valve 19. The probe cap is fixed to the end of a probe 21, and has a swirl chamber 22 formed at its outer end. Longitudinal grooves 23 and 24 on the probe cap and sleeve 17 are aligned upon relative rotation of the nozzle cap for admitting liquid product via the discharge valve through tangential channels 25 into the swirl chamber upon pumping action of the sprayer for inducing a swirl to the product to issue through the discharge orifice as a conical spray.

The foamer nozzle assembly 26 according to the invention includes a foamer cap 27 having an outer skirt 28 formed with air aspiration openings 29, and a plurality of snap-lock legs (not shown) extending from skirt 28 for snapping into suitable openings (not shown) located in end wall 31 on nozzle cap 14 which contains discharge orifice 15. Such as a snap fit arrangement is illustrated in U.S. Pat. No. 5,366,160, commonly owned herewith.

The foamer cap has an inner cylinder 32 coaxial with the discharge orifice, the cylinder having a smooth inner wall 33 terminating a predetermined distance from end wall 31. Cylinder 32 defines a turbulence chamber 34 such that, during pumping, the conical spray impacts against inner wall 33 of the turbulence chamber thereby creating and concentrating a foam as the spray particles mix with air in the turbulence chamber as aspirated through air openings 29.

According to one embodiment of the invention, foam enhancement means in the form of a grid or screen 35 of molded plastic construction which may be molded together with foamer cap 27, is located in cylinder 32 adjacent the downstream end 36 thereof and substantially parallel to end wall 31. The screen is formed of a plurality of intersecting ribs 37, 38 spaced apart to define uniform openings 39 therebetween. The back faces of the ribs 37 and 38 facing the discharge orifice are flat and lie in a common plane perpendicular to inner wall 33 of the turbulence chamber.

Thus, the conical spray discharged through orifice 15 first impacts against smooth inner wall 33 of cylinder 32 to mix with air in chamber 34 to create foam bubbles which are concentrated in the turbulence chamber whereupon the foam impacts against the flat surfaces of ribs 37 and 38 to further mix with the air in the chamber to enhance the generation of foam which passes through the screen to the target.

The combination of a turbulence chamber and a foam enhancer as aforedescribed produces a high quality foam having a small amount of large size and short duration of airborne particles.

Each of the ribs 37 and 38 can be of trapezoidal section shown in FIG. 1 with sidewalls thereof diverging in the downstream direction to enhance the flow of foam bubbles through openings 39 while retaining the flat impact surfaces at the backs of the ribs which enhances foaming formation.

Figure 4:
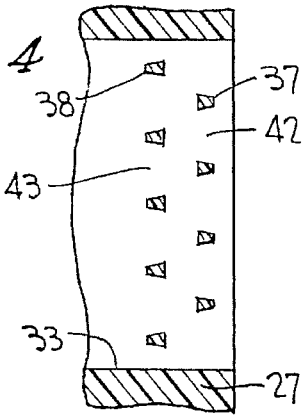
FIG. 4 is a view taken substantially along the line 4—4 of FIG. 3.
Figure 3:
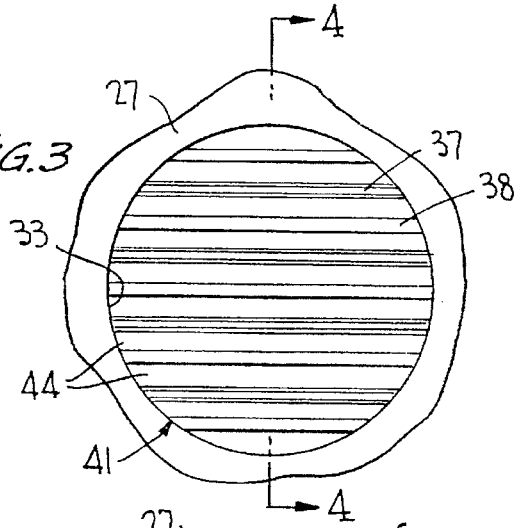
FIG. 3 is a view similar to FIG. 2 of another embodiment of the foam enhancer according to the invention.

Another embodiment of the foam enhancer according to the invention is shown in FIGS. 3 and 4 in the form of a grate or grid 41 mounted within cylinder 32 adjacent its downstream end 36. The grid comprises a plurality of ribs 37 and 38 each extending in a common direction, such as horizontal. Ribs 37 are parallel to one another and are mutually spaced apart to define uniform openings 42, of a first set of ribs.

Similarly, ribs 38 are parallel to one another and are mutually spaced apart to define uniform openings 43 of ribs in a second set. The first and second sets of ribs are relatively offset (in a vertical direction illustrated in the drawings) a distance substantially equal to one-half spacing 42 or 43, such that the net spacing of ribs between the two sets defines openings 44, as shown in FIG. 3.

With this arrangement, larger spacings 42 and 43 of the ribs in the respective sets simplify the tooling and molding operations and yield an effective spacing 44 which is substantially one-half either spacing 42 or 43.

Figure 2:
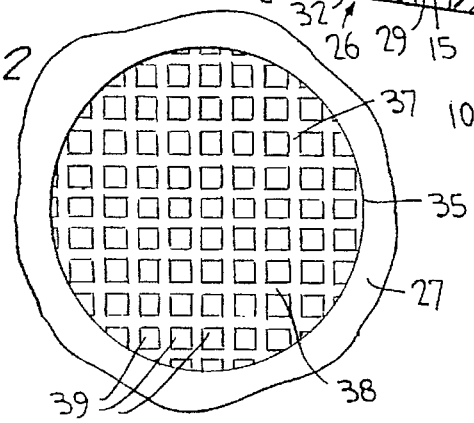
FIG. 2 is a view taken substantially along the line 2—2 of FIG. 1.

The two sets of ribs lie in spaced apart planes, the back surfaces of the ribs of both sets being flat similarly as described with reference to FIGS. 1, 2.

The ribs 37 and 38 may be trapezoidal in section, with the opposing sidewalls of the ribs of the first set converging in a downstream direction, and the opposing sidewalls of the ribs of the second set diverging in the downstream direction. Of course, ribs 37 and 38 of both sets can be so oriented that their opposing sidewalls either converge in the downstream direction or both diverge in the downstream direction.

The flat surfaces of the ribs confronting the turbulence chamber provide impact surfaces for the foam bubbles created in the chamber, enhance the foaming formation, and facilitate virtually unimpeded discharge of foam through the grid outwardly of end 36 of the foamer nozzle.

Figure 6:
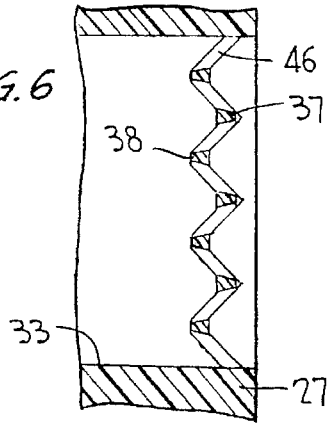
FIG. 6 is a view taken substantially along the line 6—6 of FIG. 5.
Figure 5:
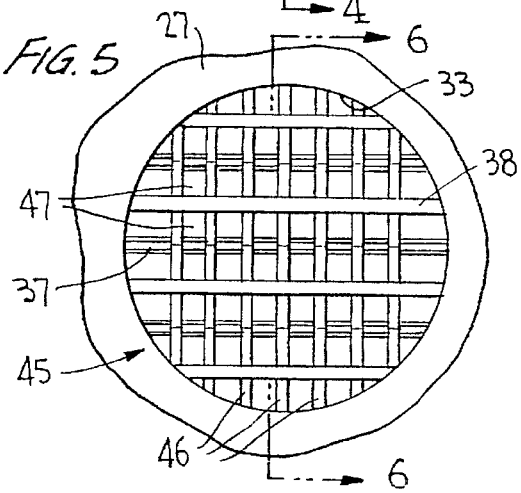
FIG. 5 is a view similar to FIG. 3 of another embodiment of a foam enhancer according to the invention.

A further embodiment of the foam enhancer according to the invention is shown in FIGS. 5 and 6 in the form of a screen 45 similar to that of screen 41 in that it includes first and second sets of relatively offset ribs 37 and 38 lying in spaced planes and the ribs being spaced apart as at 42 and 43. In addition, a third set of mutually spaced apart ribs 46 extend in a direction perpendicular to the common direction along which ribs 37 and 38 extend. Ribs 46 are zig-zag shaped and are molded to intersect with horizontal ribs 38 while extending behind or downstream of ribs 37, as shown in FIG. 6. The mutually spaced ribs of the three sets define openings 47, shown in FIG. 5. The back faces of the ribs 46 are flat and may be trapezoidal in section with the opposing sidewalls thereof either converging or diverging in the downstream direction.

The tooling and molding operations for producing screen 45, which may be integrally formed with the foamer nozzle, is less complicated and less costly by reason of the unique mesh construction primarily in permitting a greater mutual spacing between the respective ribs 37 and 38 with a net effective spacing in that direction of one-half the initial spacing.

The foam enhancer 45 of FIGS. 5, 6 functions to enhance foaming formation in a manner similar to that as described with reference to FIGS. 1, 2 and 3, 4.

Figure 8:
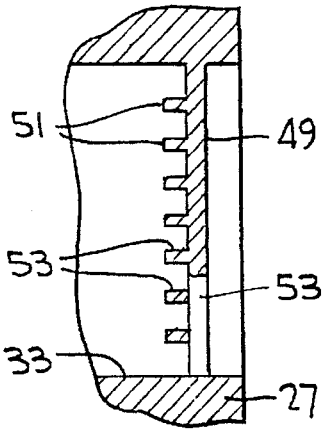
FIG. 8 is a view taken substantially along the line 8—8 of FIG. 7.
Figure 7:
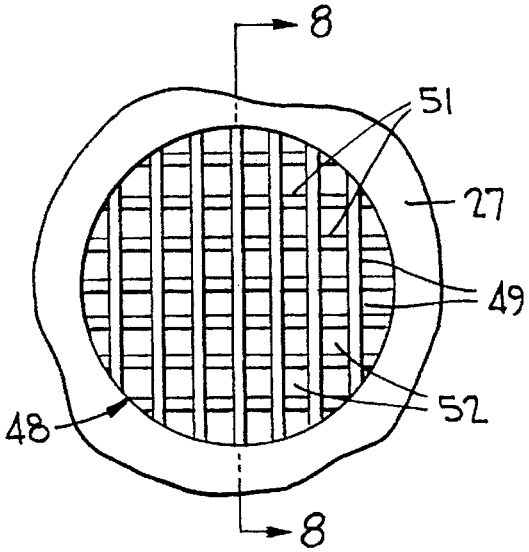
FIG. 7 is a view similar to FIG. 3 of still another embodiment of a foam enhancer according to the invention.

A still further embodiment of the foam enhancer according to the invention is shown in FIGS. 7 and 8 as a screen 48 including first and second sets of ribs 49 and 51 respectively lying in parallel planes and formed integrally at opposing ends with inner wall 33 of cylinder 32.

Ribs 49 and 51 are contiguous, the ribs of each set being respectively parallel and extending in mutually perpendicular directions forming rectangular openings 52 between the ribs of the two sets.

And, ribs 49 and 51 are each rectangular in cross-section with the longer sides 53 thereof (FIG. 8) extending along the downstream direction of product flow from the discharge orifice.

The disposition of the longer sides of the ribs along the flow path enhances the foaming formation as the foam bubbles concentrated in turbulence chamber 34 first impact against the flat surfaces of ribs 51, glide along sides 53 of ribs 51 which accelerate the turbulent flow as the foam bubbles then impact against the flat surfaces of ribs 49 and glide along sides 53 thereof which further accelerate the turbulent flow. The foam further mixes with the air in chamber 34 to enhance the generation of foam which passes through screen 48 to the target.

Figure 9:
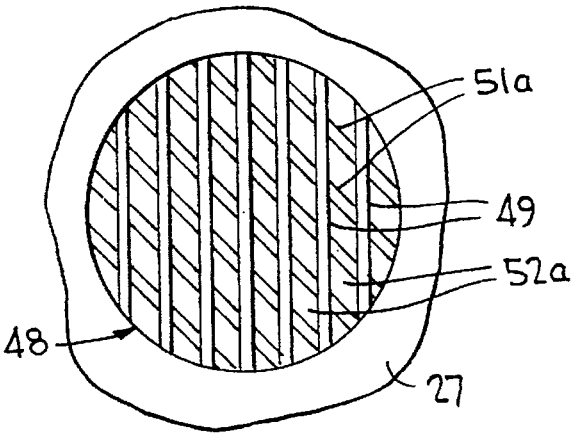
FIG. 9 is a view similar to FIG. 7 of a further embodiment of the invention.

The variant shown in FIG. 9 is similar to that of FIG. 7 except that ribs 51*a* lie at an angle other than perpendicular to ribs 49 thereby presenting non-rectangular openings 52*a*.

Figure 10:
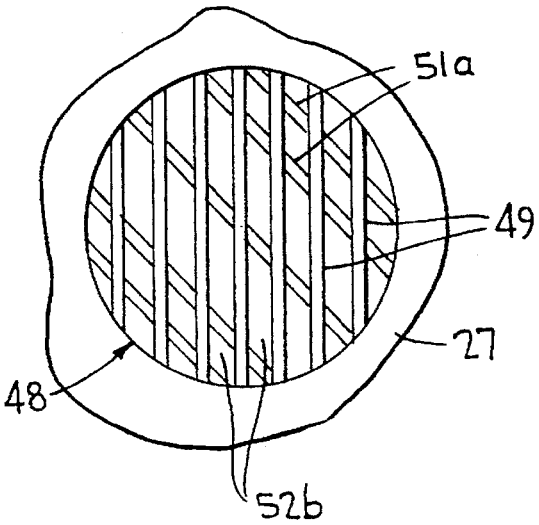
FIG. 10 is a view similar to FIG. 9 of a still further embodiment of the invention.

Otherwise, the openings 52*b* presented by the two sets of ribs can be non-uniform as in FIG. 10.

Many modifications and variations of the present invention are made possible in the light of the above teachings. For example, the ribs of the FIGS. 3, 4 embodiment can extend in a common direction which is vertical or in some other common angular direction, without departing from the invention. Otherwise, the ribs of one or both sets in any of the aforedescribed embodiments can be spaced apart to present non-uniform openings therebetween, in accordance with the invention. It is therefore to be understood that within the scope of the appended claims the invention may be practiced otherwise than as specifically described.

What is claimed is:

1. A foamer nozzle assembly mounted at a discharge end of a trigger sprayer, comprising, an inner cylinder having a smooth inner wall defining a turbulence chamber coaxial with a discharge orifice located in an end wall at said discharge end through which a conical spray is discharged in a downstream direction into said chamber for generating foam as spray particles impact against said smooth inner wall to mix with air in said chamber to form foam bubbles, foam enhancement means of molded plastic construction located in said cylinder adjacent the downstream end thereof, said means comprising first and second sets of ribs respectively lying in first and second parallel planes, said ribs of said first set being contiguous to said ribs of said second set, said ribs being mutually spaced apart in each said set to define uniformly sized openings therebetween, said ribs of both said sets having flat surfaces facing upstream and lying perpendicular to a central axis of said cylinder for further generating foam as the foam bubbles impact against said flat surfaces to further mix with the air in said chamber to create foam ejected from said downstream end of said cylinder.

2. The foamer nozzle assembly according to claim 1, wherein said openings are rectangular.

3. The foamer nozzle according to claim 1, wherein said ribs of said first and second sets extend in mutually perpendicular directions to define said openings as rectangular.

4. The foamer nozzle according to claim 1, wherein said ribs of said first and second sets are rectangular in cross-section, the longer sides of said ribs of said first and second sets extending in said downstream direction for enhancing formation of foam as the foam bubbles concentrated in the turbulence chamber first impact against the flat surfaces of one of said sets of ribs, glide along the longer sides thereof which accelerate the turbulence flow as the foam bubble then impact against the flat surfaces of the other of said sets of ribs and glide along the longer sides thereof which further accelerate the turbulence flow.

5. The foamer nozzle according to claim 1, wherein said ribs of said first and second sets extend in mutually angular, non-perpendicular directions to define said openings as non-rectangular.

6. A foamer nozzle assembly mounted at a discharge end of a trigger sprayer, comprising, an inner cylinder having a smooth inner wall defining a turbulence chamber coaxial with a discharge orifice located in an end wall at said discharge end through which a conical spray is discharged in a downstream direction into said chamber for generating foam as spray particles impact against said smooth inner wall to mix with air in said chamber to form foam bubbles, foam enhancement means of molded plastic construction located in said cylinder adjacent the downstream end thereof, said means comprising first and second sets of ribs respectively lying in spaced apart parallel planes, said ribs of said first set being equally spaced apart, and said ribs of said second set being equally spaced apart and offset relative to said ribs of said first set of distance equal to one-half the spacing of said ribs of said first set, said ribs having flat surfaces facing upstream and lying perpendicular to a central axis of said cylinder for further generating foam as the foam bubbles impact against said flat surfaces to further mix with the air in said chamber to create foam ejected from said downstream end of said cylinder.

7. The foamer nozzle assembly according to claim 6, wherein said ribs in both said sets extend only in a common direction.

8. The foamer nozzle assembly according to claim 6, wherein said ribs of said first and second sets are trapezoidal in cross-section.

9. The foamer nozzle assembly according to claim 8, wherein said first set is located downstream of said second set, opposing sidewalls of said ribs of said first set converging in a downstream direction, and opposing sidewalls of said ribs of said second set diverging in said downstream direction.

10. The foamer nozzle assembly according to claim 6, wherein said means further comprise a third set of said ribs interconnecting with and extending in a direction perpendicular to said first and second sets.

11. The foamer nozzle according to claim 10, wherein said ribs of said first, second and third sets are spaced apart to define uniformly sized openings therebetween.

12. The foamer nozzle assembly according to claim 10, wherein said ribs of said third set are zigzag-shaped in said perpendicular direction.

13. The foamer nozzle assembly according to claim 10, wherein said first set is located downstream of said second set, said ribs of said third set intersecting with said ribs of said second set and extending downstream of said ribs of said first set.

14. A foamer nozzle assembly mounted at a discharge end of a trigger sprayer, comprising, an inner cylinder having a smooth inner wall defining a turbulence chamber coaxial with a discharge orifice located in an end wall at said discharge end through which a conical spray is discharged in a downstream direction into said chamber for generating foam as spray particles impact against said smooth inner wall to mix with air in said chamber to form foam bubbles, foam enhancement means of molded plastic construction located in said cylinder adjacent the downstream end thereof, said means comprising first and second sets of ribs lying in a common plane and mutually intersecting to form uniformly sized openings therebetween, said ribs having flat surfaces facing upstream and lying perpendicular to a central axis of said cylinder for further generating foam as the foam bubbles impact against said flat surfaces to further mix with the air in said chamber to create foam ejected from said downstream end of said cylinder.

15. The foamer nozzle assembly according to claim 14, wherein said openings are rectangular.

* * * * *